US007487651B2

(12) United States Patent
Rosenzweig et al.

(10) Patent No.: US 7,487,651 B2
(45) Date of Patent: Feb. 10, 2009

(54) STEAMER WITH WRAPPED CORD AND HOSE

(75) Inventors: Mark Rosenzweig, Chestnut Hill, MA (US); Terry Robertson, Auburn, AL (US); Chad Reese, Auburn, AL (US)

(73) Assignee: Euro-Pro Operating, LLC, West Newton, MA (US)

( * ) Notice: Subject to any disclaimer, the term of this patent is extended or adjusted under 35 U.S.C. 154(b) by 713 days.

(21) Appl. No.: 11/065,701

(22) Filed: Feb. 25, 2005

(65) Prior Publication Data

US 2006/0162396 A1 Jul. 27, 2006

Related U.S. Application Data

(63) Continuation-in-part of application No. 29/221,803, filed on Jan. 21, 2005, now Pat. No. Des. 536,492.

(51) Int. Cl.
*D06F 75/14* (2006.01)

(52) U.S. Cl. ..... 68/222

(58) Field of Classification Search ..... 68/222; 15/323

See application file for complete search history.

(56) References Cited

U.S. PATENT DOCUMENTS

| | | | | | |
|---|---|---|---|---|---|
| 2,731,103 | A | * | 1/1956 | Ortega | 96/157 |
| 2,819,485 | A | * | 1/1958 | Sparklin | 15/323 |
| 2,861,838 | A | * | 11/1958 | Wyatt et al. | 239/137 |
| 3,166,777 | A | * | 1/1965 | Frantz | 15/323 |
| 3,262,145 | A | * | 7/1966 | Hays | 15/321 |
| 3,436,852 | A | * | 4/1969 | Stansbury | 38/77.6 |
| 3,480,987 | A | | 12/1969 | Schaefer | |
| 3,510,904 | A | * | 5/1970 | Lagerstrom | 15/319 |
| 4,414,037 | A | * | 11/1983 | Friedheim | 134/35 |
| 4,426,857 | A | * | 1/1984 | Epstein | 68/222 |
| 4,864,680 | A | * | 9/1989 | Blase et al. | 15/321 |
| 5,447,597 | A | * | 9/1995 | Zimmermann et al. | 156/584 |
| 5,471,556 | A | * | 11/1995 | Friedheim | 392/399 |
| 5,542,021 | A | * | 7/1996 | Hopper et al. | 392/403 |
| 5,609,047 | A | * | 3/1997 | Hellman et al. | 68/222 |
| 5,742,976 | A | * | 4/1998 | Bensussen et al. | 15/323 |
| 5,799,362 | A | * | 9/1998 | Huffman | 15/321 |
| 6,175,988 | B1 | * | 1/2001 | White et al. | 15/327.1 |
| D451,653 | S | * | 12/2001 | Berreth et al. | D32/17 |
| 6,431,217 | B2 | * | 8/2002 | Robinson | 138/110 |
| 6,502,276 | B2 | * | 1/2003 | Iversen | 420/8 |
| 6,588,052 | B2 | * | 7/2003 | Iversen | 15/323 |

OTHER PUBLICATIONS

International Search Report dated Oct. 5, 2007, issued in PCT/US06/06464.
Written Opinion of the International Searching Authority.

* cited by examiner

*Primary Examiner*—Frankie L Stinson
(74) *Attorney, Agent, or Firm*—Venable LLP; Ralph P. Albrecht; Ryan M. Flandro

(57) ABSTRACT

A device for generating and supplying steam is provided. The device has a body, a steam generation unit, a first side panel attached to the body, a second side panel attached to the body, a power cord attached to the steam generation unit, a supply hose for supplying the steam from the steam generation unit to a point of use of the steam, a first wrapping location formed between the body and the first side panel, and a second wrapping location formed between the body and the second side panel. The first wrapping location is for wrapping the power cord for storage, and the second wrapping location is for wrapping the supply hose for storage.

21 Claims, 7 Drawing Sheets

STEAMER WITH WRAPPED CORD AND HOSE

This application is a Continuation-In-Part of U.S. Design patent application Ser. No. 29/221,803 filed Jan. 21, 2005.

BACKGROUND OF THE INVENTION

1. Field of the Invention

The present invention relates generally to steamers. More particularly, the invention relates to portable steamers with a cord and a hose that wrap around the steamer for storage.

2. Related Art

Portable steamers used for cleaning have become increasingly more popular in recent years. Portable steamers can be battery-powered or can require plugging into an electrical outlet. Most steamers have a hose for transporting the steam from a steam generation unit, or boiler, to the point of use of the steam. A problem associated with many portable steamers is storage of the steam supply hose and, if present, the electrical power cord when the steamer is not in use.

BRIEF SUMMARY OF THE INVENTION

The invention addresses the problem of how to store the steam supply hose and the electrical power cord when the steamer is not in use. This problem is addressed by providing areas on the body of the steamer for wrapping the steam supply hose and the power cord around the body (or other portion of the steamer) to provide a neat and easy way to store the steam supply hose and the power cord.

Particular embodiments of the invention provide a device for generating and supplying steam. The device has a body, a steam generation unit, a first side panel attached to the body, a second side panel attached to the body, a power cord attached to the steam generation unit, a supply hose for supplying the steam from the steam generation unit to a point of use of the steam, a first wrapping location formed between the body and the first side panel, and a second wrapping location formed between the body and the second side panel. The first wrapping location is for wrapping the power cord for storage, and the second wrapping location is for wrapping the supply hose for storage.

Other embodiments of the invention provide a device for generating and supplying steam. The device has a body, a steam generation unit, a first side panel attached to the body, a second side panel attached to the body, a power cord attached to the steam generation unit, a supply hose for supplying the steam from the steam generation unit to a point of use of the steam, a first wrapping location formed on the body and bounded by the first side panel, and a second wrapping location formed on the body and bounded by the second side panel. The first wrapping location is for wrapping the power cord for storage, and the second wrapping location is for wrapping the supply hose for storage.

Other embodiments, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of preferred embodiments of the invention, as illustrated in the accompanying drawings wherein like reference numbers generally indicate identical, functionally similar, and/or structurally similar elements.

DETAILED DESCRIPTION OF THE INVENTION

Figure 1:
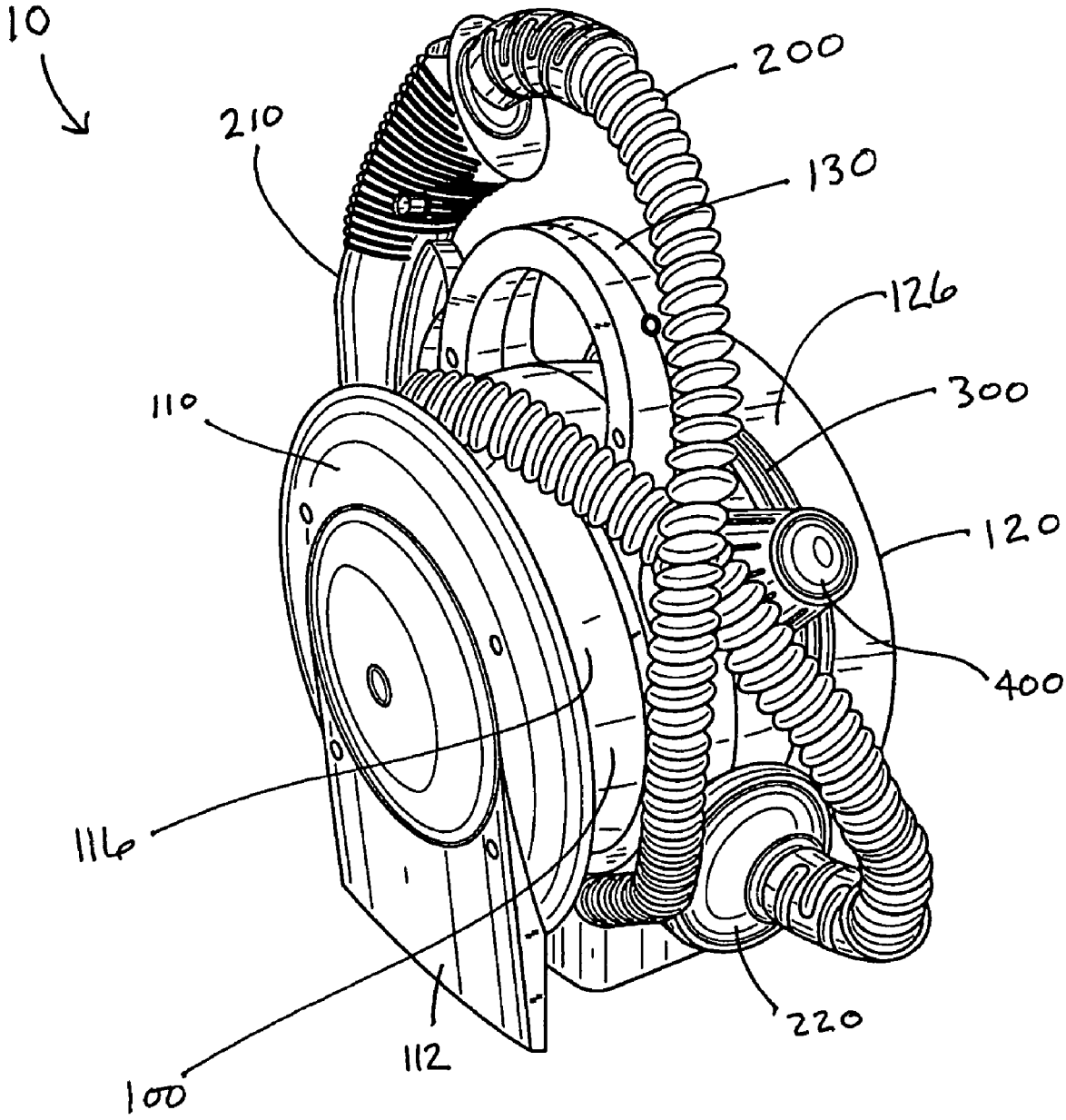
FIG. 1 is a perspective view of an embodiment of the invention.

An exemplary embodiment of the invention is shown in the drawings and described herein. The example of the invention shown in the drawings is a steamer 10 having a body 100 that contains a steam generation unit, or boiler. Attached to one side of body 100 is a side panel 110 having a support leg 112. Attached to the opposite side of body 100 is a side panel 120 having a support leg 122 (best seen in FIGS. 4 and 5). Steamer 10 is also provided with a handle 130 to facilitate carrying steamer 10.

A hose 200 is provided for directing the steam from the steam generation unit to the point of use of the steam. Hose 200 is connected to the steam generation unit by way of a hose connection port 220 and has, at its opposite end, a steam wand 210. Steam wand 210 provides a comfortable way to grip the end of hose 200 and direct the steam where needed.

Figure 2:
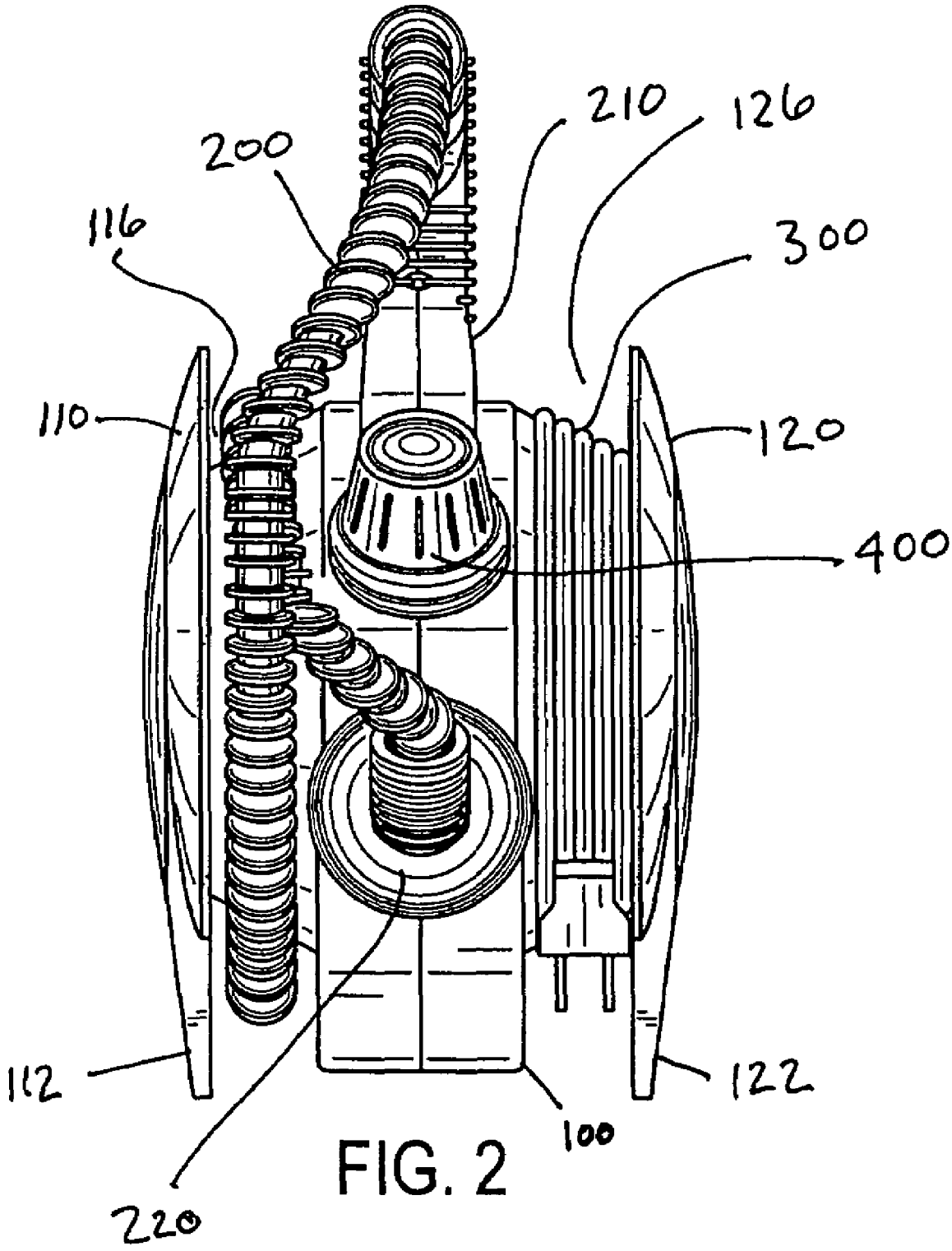
FIG. 2 is a front view of the embodiment shown in FIG. 1.
Figure 3:
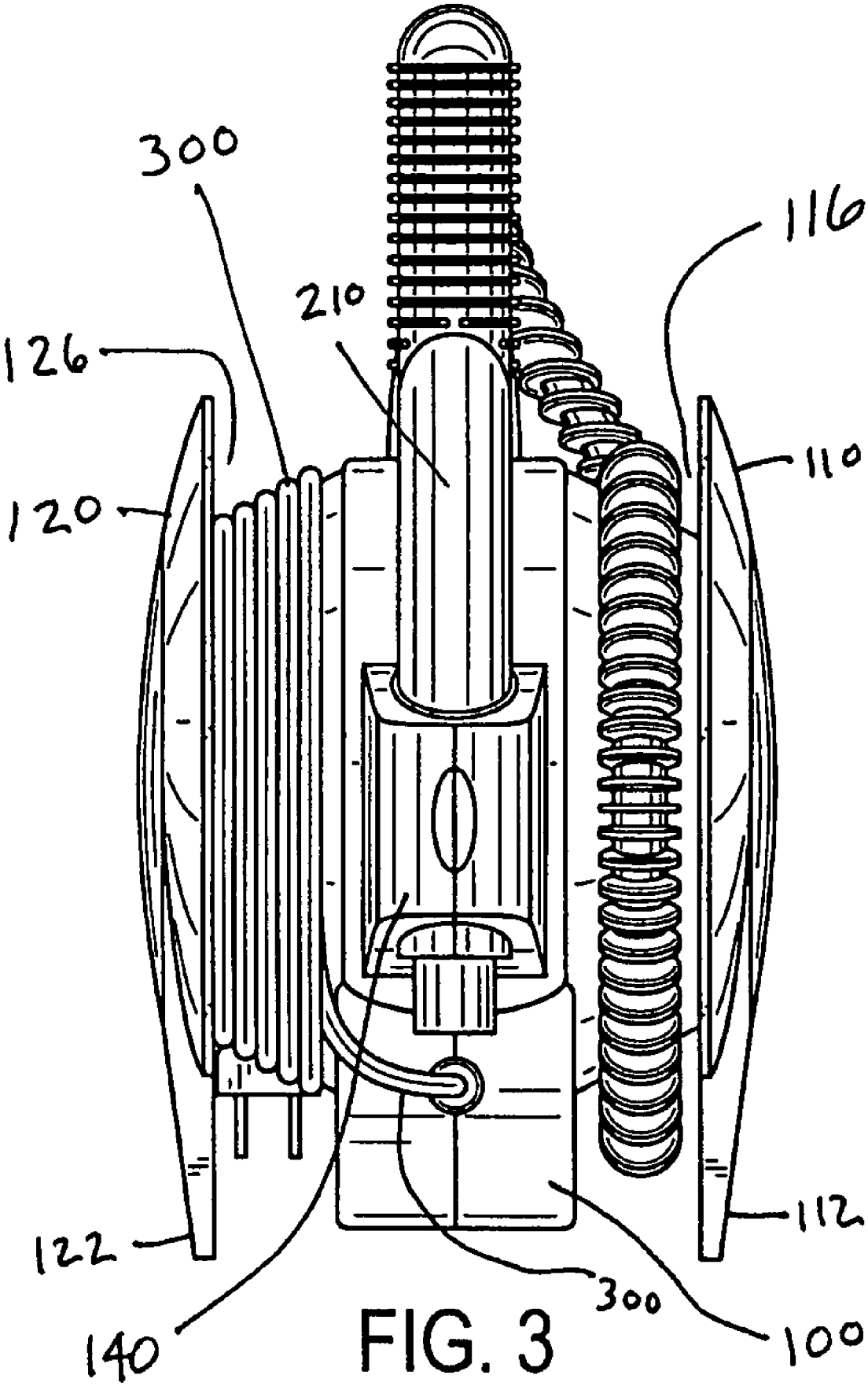
FIG. 3 is a rear view of the embodiment shown in FIG. 1.

The figures show hose 200 being wrapped around body 100 in a wrapping location 116 formed by body 100 and side panel 110 (best shown in FIGS. 2 and 3). In alternate embodiments, wrapping location 116 is formed by the body alone and the body is configured to provide horizontal constraint for hose 200 as well as vertical constraint.

A power cord 300 is provided to connect the steam generation unit to an electrical outlet. A wrapping location 126 is formed by body 100 and side panel 120 to provide a storage location for power cord 300. In alternate embodiments, wrapping location 126 is formed by the body alone and the body is configured to provide horizontal constraint for power cord 300 as well as vertical constraint.

As shown by the drawings, wrapping locations 116, 126 provide convenient and neat storage of hose 200 and power cord 300.

In this embodiment, side panels 110, 120 and body 100 are generally circular in shape. It is noted, however, that other shapes can also be used. For example, oval or polygonal shapes can be used. Also, although support legs 112, 122 are each shown as having a single contact area for contacting the surface on which steamer 10 sits, it is noted that support legs having two or more contact points each and/or having different shapes can also be used.

Side panels 110, 120 can be removable so that they can be replaced by side panels having different shapes or colors. For example, side panels 110, 120 can be triangular shaped with the lower leg of each triangle acting as the contact point (or support leg). Interchangeable side panels may be desirable to alter the color or shape of steamer 10 and thus its visual impact.

In this example, steamer 10 is also provided with a filler cap and pressure relief safety valve 400. Filler cap and pressure relief safety valve 400 can be removed to fill steamer 10 with water and, in this example, includes a pressure relief safety valve that vents pressure to the atmosphere if the internal pressure of the steam generation unit rises above a predetermined value.

Figure 4:
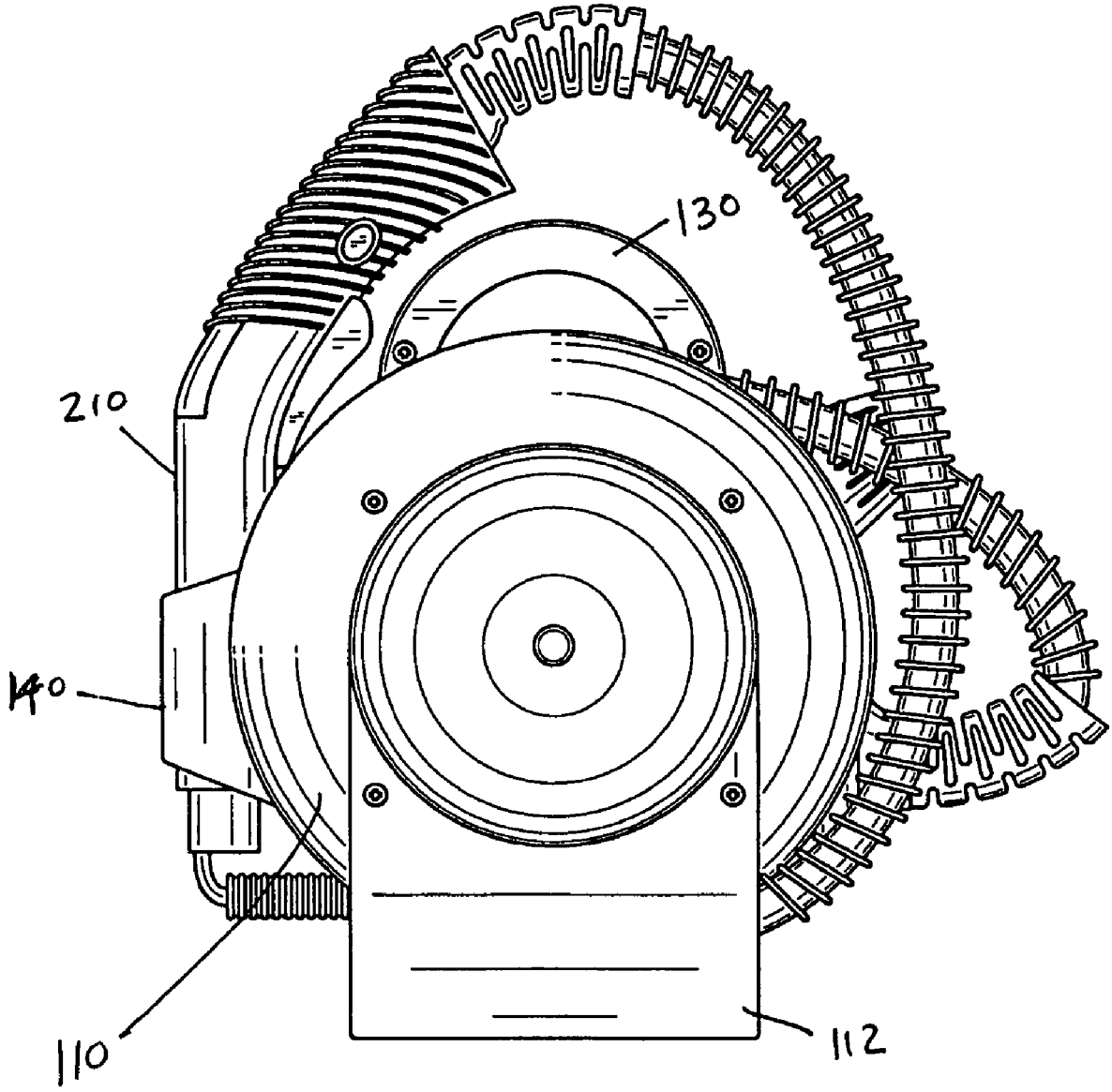
FIG. 4 is a left side view of the embodiment shown in FIG. 1.
Figure 5:
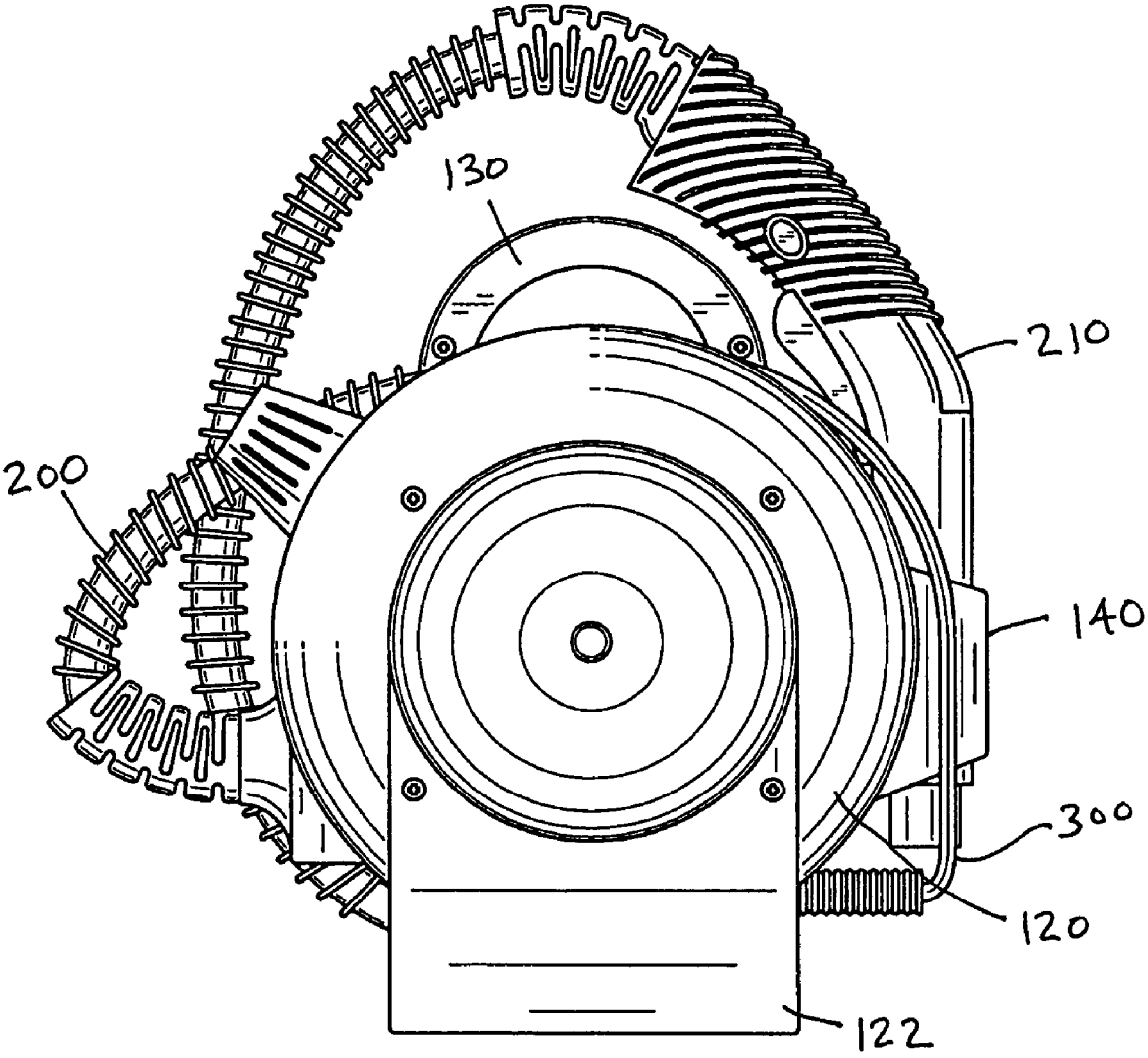
FIG. 5 is a right side view of the embodiment shown in FIG. 1.
Figure 6:
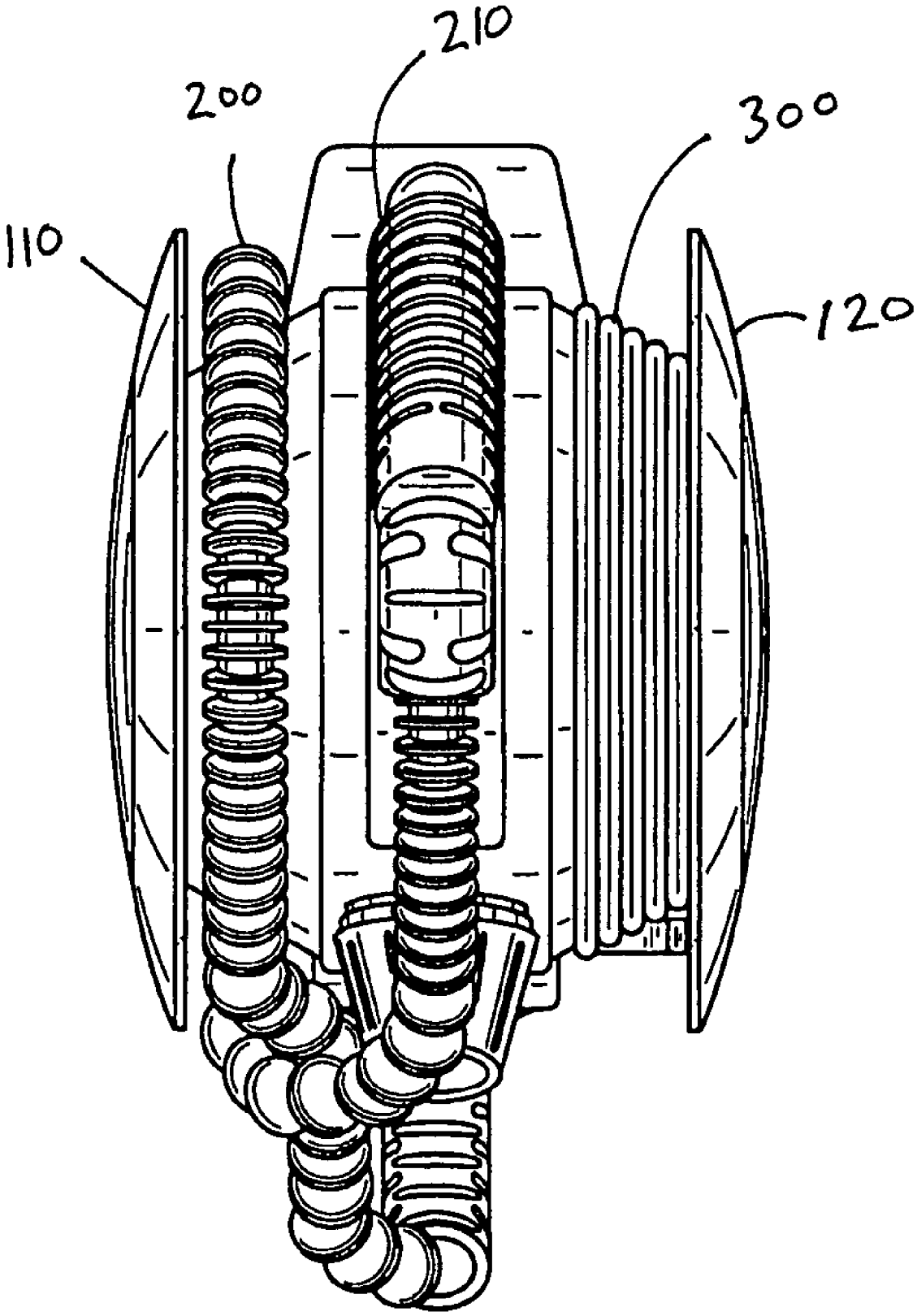
FIG. 6 is a top view of the embodiment shown in FIG. 1.
Figure 7:
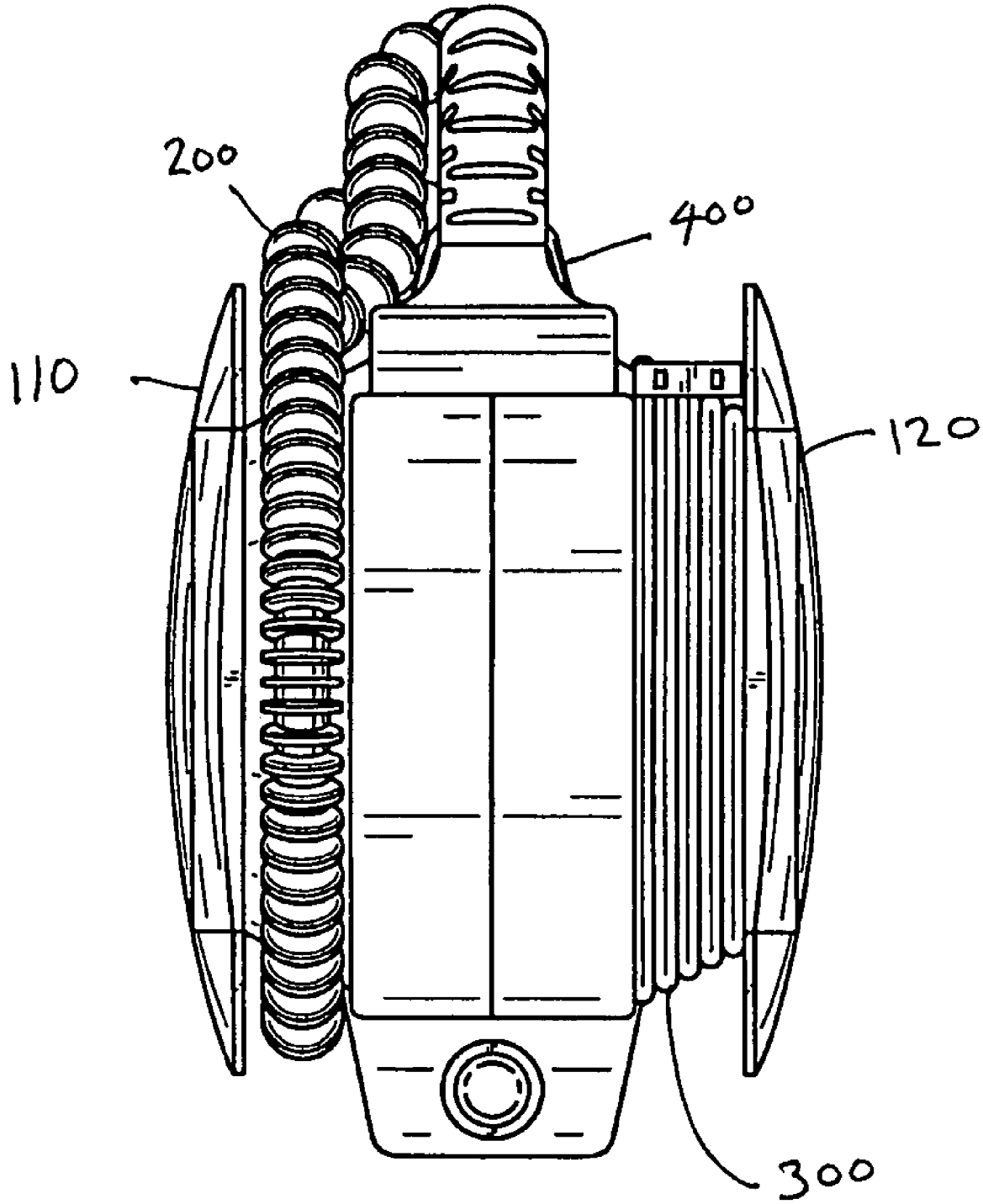
FIG. 7 is a bottom view of the embodiment shown in FIG. 1.

As shown in FIGS. 3-5, a wand holder 140 is provided on body 100 to hold steam wand 210 when not in use.

The embodiments illustrated and discussed in this specification are intended only to teach those skilled in the art the best way known to the inventors to make and use the invention. Nothing in this specification should be considered as limiting the scope of the invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

What is claimed is:

1. A device for generating and supplying steam, comprising:

a body;

a steam generation unit;

a first side panel attached to the body and having a first support leg extending from its perimeter;

a second side panel attached to the body and having a second support leg extending from its perimeter;

a power cord attached to the steam generation unit;

a supply hose for supplying the steam from the steam generation unit to a point of use of the steam;

a first wrapping location formed between the body and the first side panel; and a second wrapping location formed between the body and the second side panel, wherein the first wrapping location is for wrapping the power cord for storage, and the second wrapping location is for wrapping the supply hose for storage.

2. The device of claim 1, wherein the first side panel is on a first side of the body and the second side panel is on a second side of the body opposite to the first side.

3. The device of claim 1, wherein the first side panel is circular and the second side panel is circular.

4. The device of claim 1, wherein the steam generation unit is contained within the body.

5. The device of claim 1, wherein the body is generally circular in cross section.

6. The device of claim 1, further comprising a handle extending from the body.

7. The device of claim 1, further comprising a steam supply wand attached to an end of the steam supply hose.

8. The device of claim 7, further comprising a wand holder attached to the body for securing the wand in a storage position.

9. The device of claim 1, wherein the side panels are removable from the body such that the side panels are interchangeable with other side panels.

10. The device of claim 1, wherein the first side panel is on a first side of the body and the second side panel is on a second side of the body opposite to the first side, the first side panel is circular, the second side panel is circular, and the body is generally circular in cross section.

11. A device for generating and supplying steam, comprising:

a body;

a steam generation unit;

a first side panel attached to the body and having a first support leg extending from its perimeter;

a second side panel attached to the body and having a second support leg extending from its perimeter;

a power cord attached to the steam generation unit;

a supply hose for supplying the steam from the steam generation unit to a point of use of the steam;

a first wrapping location formed on the body and bounded by the first side panel; and a second wrapping location formed on the body and bounded by the second side panel, wherein the first wrapping location is for wrapping the power cord for storage, and the second wrapping location is for wrapping the supply hose for storage.

12. The device of claim 11, wherein the first side panel is on a first side of the body and the second side panel is on a second side of the body opposite to the first side.

13. The device of claim 11, wherein the first side panel is circular, and the second side panel is circular.

14. The device of claim 11, wherein the steam generation unit is contained within the body.

15. The device of claim 11, wherein the body is generally circular in cross section.

16. The device of claim 11, further comprising a handle extending from the body.

17. The device of claim 11, further comprising a steam supply wand attached to an end of the steam supply hose.

18. The device of claim 17, further comprising a wand holder attached to the body for securing the wand in a storage position.

19. The device of claim 11, wherein the side panels are removable from the body such that the side panels are interchangeable with other side panels.

20. The device of claim 11, wherein the first side panel is on a first side of the body and the second side panel is on a second side of the body opposite to the first side, the first side panel is circular, the second side panel is circular, and the body is generally circular in cross section.

21. A device for generating and supplying steam, comprising:

a body;

a steam generation unit;

a first side panel attached to the body;

a second side panel attached to the body;

a power cord attached to the steam generation unit;

a supply hose for supplying the steam from the steam generation unit to a point of use of the steam;

a first wrapping location formed between the body and the first side panel for wrapping the power cord for storage; and a second wrapping location formed between the body and the second side panel for wrapping the supply hose for storage, wherein the first and second side panels are removable from the body such that the side panels are interchangeable with other side panels.

* * * * *